US005924478A

United States Patent [19]

Crocker

[11] Patent Number: 5,924,478

[45] Date of Patent: Jul. 20, 1999

[54] RADIATOR WASHING SYSTEM AND METHOD

[75] Inventor: Steven E. Crocker, Weymouth, Mass.

[73] Assignee: Caterpillar Inc., Peoria, Ill.

[21] Appl. No.: 08/848,441

[22] Filed: May 8, 1997

[51] Int. Cl.[6] ..... F28G 1/16

[52] U.S. Cl. ..... 165/95; 134/198

[58] Field of Search ..... 165/95; 134/198

[56] References Cited

U.S. PATENT DOCUMENTS

| | | | |
|---|---|---|---|
| 2,379,506 | 7/1945 | Yerrick et al. . | |
| 2,558,752 | 7/1951 | Holm . | |
| 3,828,570 | 8/1974 | Stutz | 165/95 X |
| 4,196,020 | 4/1980 | Hornak et al. . | |
| 4,428,417 | 1/1984 | Chesner . | |
| 4,660,627 | 4/1987 | Deck | 165/95 X |
| 4,666,531 | 5/1987 | Minard | 165/95 X |
| 4,690,159 | 9/1987 | Vadakin et al. . | |
| 4,705,057 | 11/1987 | Mohr et al. . | |
| 4,771,822 | 9/1988 | Barbosa | 165/41 |
| 4,815,523 | 3/1989 | Dehli et al. . | |
| 4,884,416 | 12/1989 | Hwang | 62/303 |
| 5,101,775 | 4/1992 | Hubbs | 123/41.01 |
| 5,186,240 | 2/1993 | Kennon et al. | 165/95 |
| 5,211,028 | 5/1993 | Remo | 165/95 X |
| 5,392,798 | 2/1995 | Hirose et al. . | |

FOREIGN PATENT DOCUMENTS

| | | | |
|---|---|---|---|
| 2923465 | 12/1980 | Germany | 165/95 |
| 266395 | 11/1987 | Japan | 165/95 |
| 2087029 | 5/1982 | United Kingdom | 165/95 |

*Primary Examiner*—Leonard Leo
*Attorney, Agent, or Firm*—Alan J. Hickman

[57] ABSTRACT

A mobile work machine is provided with an onboard washing system. The washing system has a mixing device which mixes a predetermined amount of concentrated cleaning fluid with water based on the flow rate of water passing through the mixing device and delivers a resulting washing fluid mixture to a sprayer for delivery by a plurality of nozzles toward a radiator core. A fan further induces the washing fluid mixture to pass through the radiator core.

12 Claims, 4 Drawing Sheets

20
34
14
12
16
26
28
32
36
50
22
30
24
28
32
60
42
86
82
80
44
76
74
40
18
10

RADIATOR WASHING SYSTEM AND METHOD

TECHNICAL FIELD

This invention relates to a radiator washing system and method and more particularly to a radiator washing system which is carried on the frame of a mobile work machine.

BACKGROUND ART

Mobile work machines, for example, off highway trucks, excavators, tractors, motor graders, wheel loaders, scrapers and the like operate in a dirty environment. Dust and other airborne particles are directed by the cooling fan of the machine through the core of the heat exchanger. These particles collect on the core of the heat exchanger and particularly the heat transfer fins. Build up of dirt over time restricts air flow and reduces heat transfer for cooling purposes. Overheating of the internal combustion engine powering the machine will occur when the build up of dirt on the radiator core is sufficient to prevent adequate heat transfer.

The machine operator currently manually cleans the radiator core of dirt using soap and water. The frequency of cleaning is a function of the work environment in which the mobile work machine operates. In extremely dirty environments, the frequency may exceed once a day. This is unacceptable as machine down time required for cleaning the radiator core reduces overall machine productivity.

Radiator cores often become exceptionally dirty before an operator addresses the need for cleaning. As a result, the internal combustion engine may operate for extended periods of time at temperatures greater than desired. This results in a reduction in the life and efficiency of engine operation.

Washing systems for heat exchangers and regenerators used in stationary, non-mobile machine applications have been known for some time. These systems tend to be bulky, complicated in construction, and not suitable for use in mobile work machine applications.

The present invention is directed to overcoming one or more of the problems set forth above.

DISCLOSURE OF THE INVENTION

A washing system for a mobile work machine having a frame and an internal combustion engine mounted on said frame is provided. A sprayer has a manifold and a plurality of spaced apart nozzles connected to the manifold. The sprayer is connected to the frame and the nozzles are adapted to deliver a washing fluid mixture spray. A radiator having a cooling core and is connected to the frame. The radiator is connected to cool the engine. The radiator is positioned on the frame at a location to receive the spray of the washing fluid mixture. A concentrate reservoir is connected to the frame and adapted to carry a concentrated cleaning fluid. A mixing device is connected to the machine frame, the concentrate reservoir, a source of pressurized water flow and the manifold. The mixing device draws concentrated cleaning fluid from the concentrate reservoir, combines a predetermined amount of the concentrated cleaning fluid with the water based on the rate of water flowing through the mixing device, and delivers the resulting washing fluid mixture to the manifold to be sprayed by the nozzles.

A method for washing a radiator core during operation of a mobile work machine, comprises the steps of: passing a pressurized flow of water through a mixing device located on the mobile work machine, drawing a concentrated cleaning fluid from a concentrate fluid reservoir located on the mobile work machine, mixing the water flowing through the mixing device with the concentrated cleaning fluid, delivering a washing fluid mixture of the water and the concentrated cleaning fluid to a manifold, and spraying the washing fluid mixture toward the radiator core.

BEST MODE FOR CARRYING OUT THE INVENTION

Figure 1:
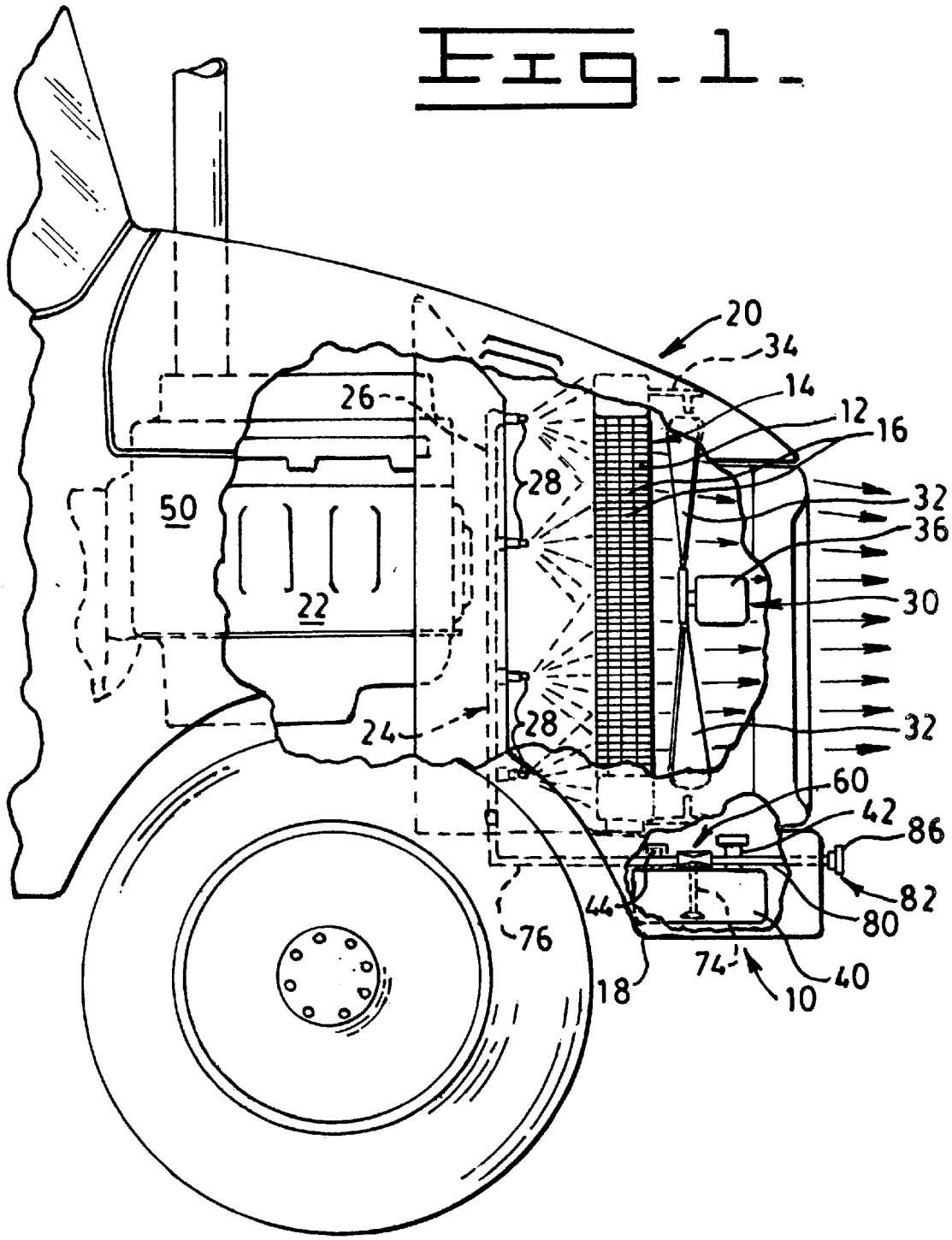
FIG. 1 is a diagrammatic side view of an embodiment of the present invention showing a wheel loader with portions broken away disclosing a radiator washing system and suction fan arrangement.
Figure 2:
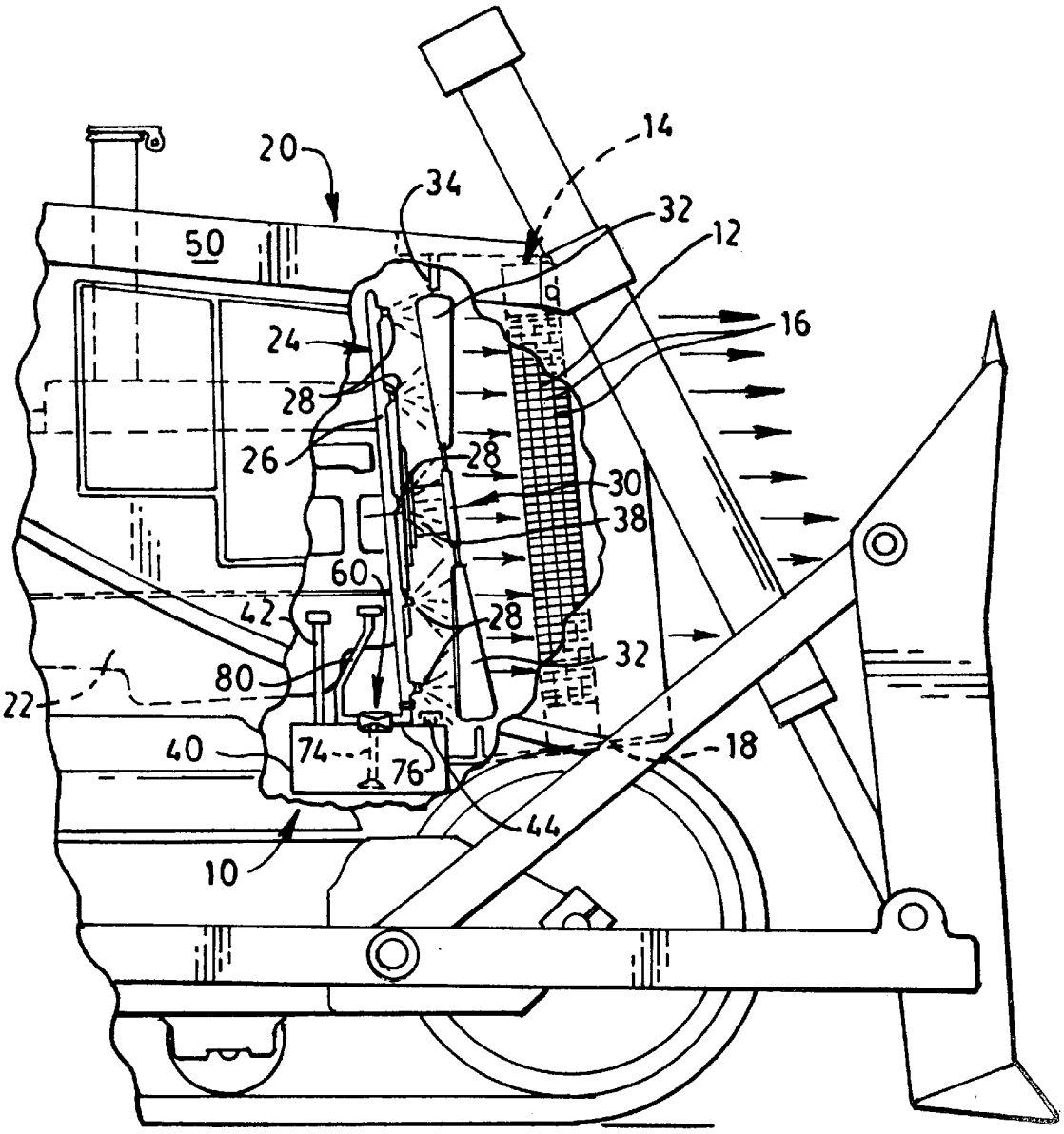
FIG. 2 is a diagrammatic side elevational view of an embodiment of the present invention showing a track type tractor with portions broken away disclosing a radiator washing system and blower fan arrangement.
Figure 3:
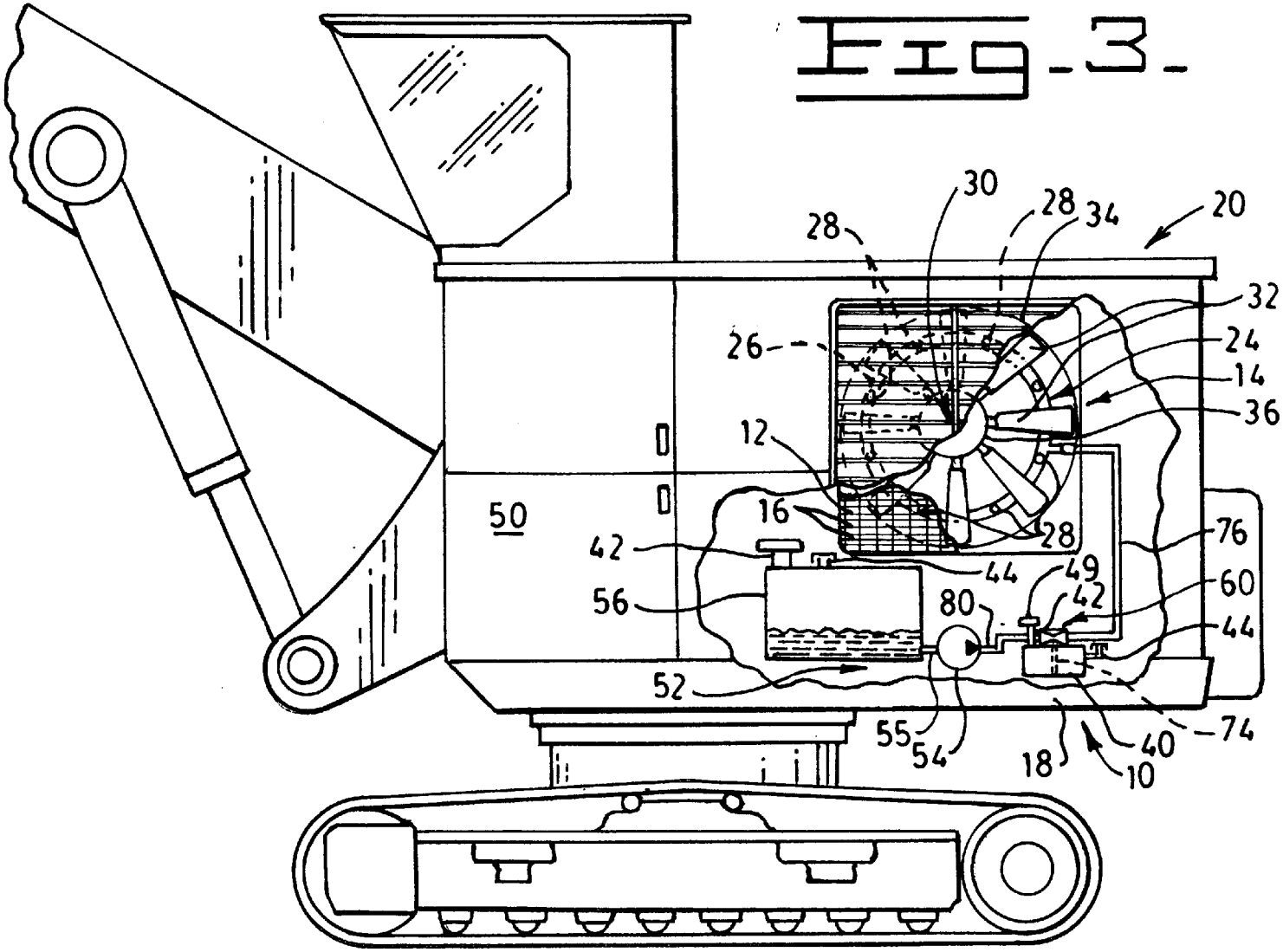
FIG. 3 is a diagrammatic side elevational view of an embodiment of the present invention showing an excavator with portions broken away disclosing a radiator washing system and onboard water supply.

With reference to the drawings, particularly FIGS. 1–3, a washing system 10 is shown for washing the core 12 of a radiator 14 having a plurality of fins 16 for heat transfer purposes. The radiator 14 is mounted on the frame 18 of a mobile work machine 20, for example, an earth working machine such as, an off highway truck, an excavator, a tractor, a motor grader, a wheel loader, a scraper and the like, and is connected to cool an internal combustion engine 22 in a conventional manner.

The washing system 10 includes a sprayer 24 having a manifold 26 and a plurality of spaced apart nozzles 28 connected to the manifold 26. The manifold 26 is connected to the frame 18 and located adjacent the core 12. The manifold 26 has an internal passage (not shown) disposed therein for passing a washing fluid mixture to each of the plurality of nozzles 28. The nozzles 28 are of any suitable conventional type capable of providing a desired spray pattern. As shown FIGS. 1–3, the spray pattern is cone shaped. Preferably, the nozzles 28 are screw threadably connected to the manifold 26 and rotatable relative to the manifold for adjusting the size of the spray pattern. As best seen in FIG. 3, the manifold 26 is preferably circular in shape, and the nozzles 28 are oriented to spray in generally a common direction toward the radiator core 12. The nozzles 28 are equally spaced apart a predetermined distance and provide a desired amount of spray pattern overlap with adjacent spray nozzles, an adequate volume of washing fluid mixture, and an adequate amount of radiator core coverage.

A fan 30 is provided to urge the spray of washing fluid mixture delivered from the nozzles 28 through the radiator core 12 at a velocity sufficient to wash the buildup of particles from the radiator core. The fan 30 is preferably, but not limited to, an axial fan having a plurality of spaced fan blades 32. The fan 30 is mounted on the frame 18 in any suitable conventional manner. The fan 30 is located next to the radiator 14 and within a shroud 34 connected to the radiator 14.

As shown in FIG. 1, the fan 30 is driven by a hydraulic motor 36. Rotation of the fan 30 induces cooling air to flow through the radiator core. This induction of cooling air flow also causes the spray of washing fluid mixture to be urged through the radiator core 12 at a substantial velocity. As can be seen in this embodiment, the radiator is positioned between the manifold 26 of the sprayer 24 and the fan 30, and the air flow is in the direction of the arrows.

Referring to FIG. 2, the fan 30 is driven mechanically by the engine 22 by way of either a pulley and belt or a direct drive arrangement 38 of conventional design. In this embodiment, the fan 30 positively urges (blows) the air through the radiator core 12. This forcing of cooling air flow also forces the spray of washing fluid mixture through the radiator core at a substantial velocity. As can be seen, the fan 30 is disposed between the manifold 26 of the sprayer 24 and the core 12 of the radiator 14, and the air flow is in the direction of the arrows.

As shown in FIG. 3, the manifold 26 is centrally located relative to the radiator core 12 and substantially equally spaced from each of the sides of the radiator core 12. A center of rotation of the fan 30 is substantially axially aligned with a geometric center of the radiator core 12. This central location of the manifold 26 and fan 30 also pertains to the embodiments described in FIGS. 1 and 2 above.

As shown in FIGS. 1–3, a concentrate reservoir 40 is connected to the frame 18 and carried by the mobile work machine 20. The concentrate reservoir 40, which is shown as a rectangular tank of any suitable metallic or non-metallic material, has a fill tube 42 and a vent pipe 44. The concentrate reservoir 40 is suitable for carrying a concentrated cleaning fluid of any suitable composition therein.

The vent pipe 42 is open to the reservoir 40 and the atmosphere, vents the concentrate reservoir 40 to the atmosphere, and prevents a build up of pressure within the reservoir. A vent cap 46 may be provided on the vent pipe 44 to prevent inadvertent spillage of concentrated cleaning fluid carried in the concentrate reservoir 40.

The fill tube 42 is open to the concentrate reservoir 40 and to the atmosphere. The fill tube 42 is adapted to transfer concentrated cleaning fluid from an external source of concentrate cleaning fluid supply to the concentrate reservoir 40. A cap 48 is provided on the fill tube 42 to seal the end thereof an prevent spillage of concentrated cleaning fluid. The concentrate fill tube has a filling end 49. The filling end 49 may be located external of a body 50 of the mobile work machine 20 for ease of access and filling.

Figure 4:
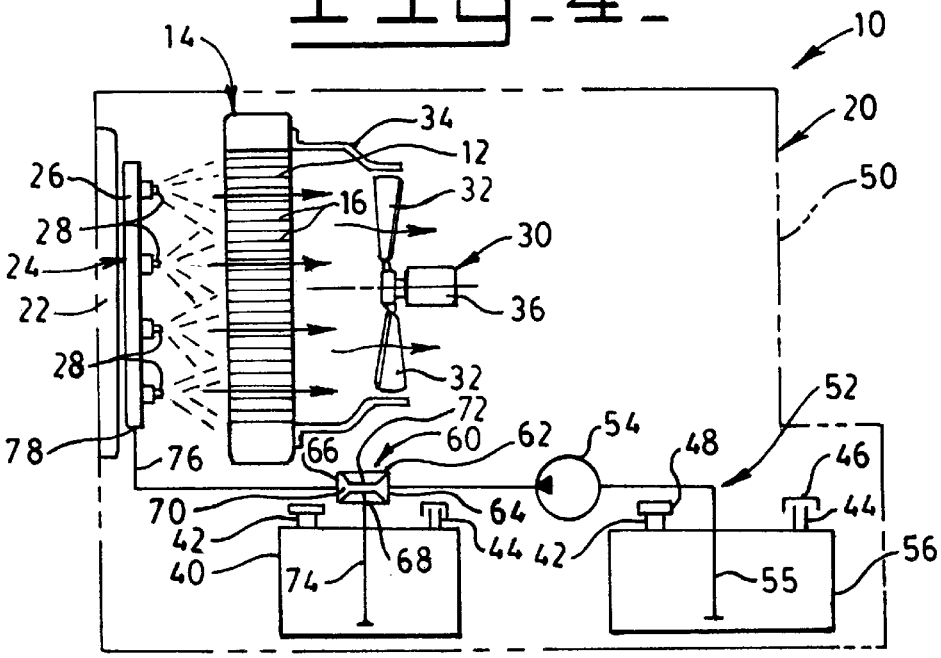
FIG. 4 is a diagrammatic schematic showing an embodiment of the radiator washing system with an onboard water supply.
Figure 5:
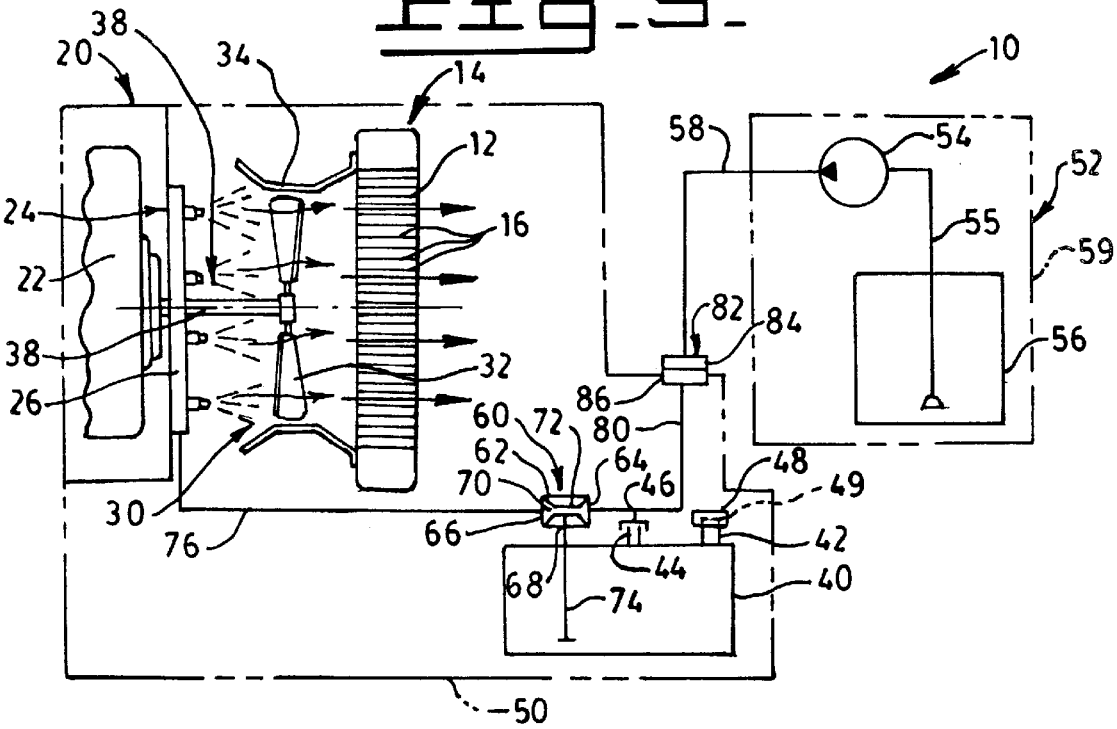
FIG. 5 is a diagrammatic schematic of a radiator washing system with a remote water supply.

A source of water flow 52 provides a pressurized water source for the sprayer 24. The source 52 is provided either on or remote from the mobile work machine 20. As best seen in FIGS. 4 and 5, the source 52 includes a pump 54, a water carrying reservoir 56, a supply conduit 55 connected to the pump 54 and disposed in the water carrying reservoir 56, and a delivery conduit 58 connected to the pump. The pump 54 draws water from the reservoir 56 by way of the conduit 55 and delivers pressurized water flow by way of delivery conduit 58. In FIGS. 1,2 and 5, the source 52 is a remote device 59 from the mobile work machine 20, This remote device 59 includes a stationary mounted water pumping station or a mobile water pumping machine, for example, a water truck. In FIGS. 3 and 4, the source 52 is mounted on the frame 18 of the mobile work machine 20 and readily available for use.

A mixing device 60 is connected to the machine frame 18, the concentrate reservoir 40, and the manifold 26. The mixing device 60 draws concentrated cleaning fluid from the concentrate reservoir 40, combines a predetermined amount of the concentrated cleaning fluid with water delivered from the source 52 of pressurized water flow to the mixing device 60 based on the rate of water flowing through the mixing device 60, and delivers a resulting washing fluid mixture to the manifold 26 for spraying by the nozzles 28.

Referring to FIGS. 4 and 5, the mixing device 60 has a body 62, an inlet port 64, an outlet port 66, a suction port 68, and a venturi passage 70 having a throat portion 72. The venturi passage 70 is open to the inlet and outlet ports 64,66 and the throat portion 72 is open to the suction port 68. A suction tube 74 is connected to the suction port 68 and disposed in the concentrate reservoir 40. A conduit 76 connects the outlet port 66 to an inlet port 78 of the manifold 26 and a conduit 80 connects the inlet port 64 to the source 52 of pressurized water flow. It is to be recognized that in applications where the source of pressurized water flow 52 is mounted on the machine 20, the need for the delivery conduit 58 is eliminated and conduit 80 is connected to the pump 54.

Referring to FIG. 5, a coupling 82 is provided for connecting the mixing device 60 to the source 52 of pressurized water flow. The coupling is provided in applications such as shown on FIG. 5 where the source 52 is separate and free from being carried on the mobile work machine 20. The coupling 82 has male and female portions 84,86. The female portion 86 is connected to conduit 80 at an end thereof and the male portion 84 is connected to an end of conduit. It should be recognized that the male and female portions 84,86 may be reversed without departing from the spirit of the invention. The male and female portions 84,86 are connectable together in any suitable manner, for example, by screw threads, by a bayonet and sleeve connection and the like. Preferably, the coupling 82 provides quick connection and disconnection capabilities and is capable of withstanding the flow and pressure of the water being passed thereby.

In order to facilitate ease of connection of the male and female portions 84,86, the coupling 82 is preferably external relative to the body 50 of the mobile work machine. This provides for ease of connection to the source 52 of pressurized fluid flow.

INDUSTRIAL APPLICABILITY

With reference to the drawings, particularly FIGS. 4 and 5, the washing system 10 associated with the mobile work machine 20 is effective for removing debris, dirt and the like from the radiator core 12 in an efficient and effective manner. The washing system 10 facilitates washing of the radiator at substantially any time during machine operation which eliminates excessive down time and loss of production.

The washing system is operated in one of two ways. In the embodiment of FIG. 4, the machine operator or another person simply directs, in any appropriate well known manner, the source 52 of pressurized fluid flow to deliver pressurized water flow to the sprayer 24. For example, the operator may actuate a control valve (not shown) disposed in conduit 80 between the pump 54 and the mixing device, to open and pass pressurized water flow to the manifold 26 by way of the mixing device 60. In the embodiment of FIG. 5, the operator or another person utilizes the coupling 82 to connect the source 52 to the conduit 80 and subsequently deliver pressurized water flow to the sprayer 24.

Water flow from the source 52 is directed to the mixing device 60 and enters the inlet port 64. The water flowing through the venturi passage 70 induces concentrated cleaning fluid to flow from the concentrate reservoir 40, through suction tube 74, and into the throat portion 72 of the venturi passage 70. The concentrated cleaning fluid is mixed with the water flowing through the venturi passage 70 at a predetermined, established rate based on the flow rate of water passing through the throat portion 72 and is delivered as a washing fluid mixture by conduit 76 to the manifold 26 of the sprayer 24.

The washing fluid mixture enters the manifold 26 and is delivered by way of the internal manifold passage to the nozzles. The nozzles 28 spray the washing fluid mixture toward the radiator core 12 in an overlapping pattern as previously discussed. The washing fluid mixture spray is directed at a flow rate established by the pump. The fan 30 further increases the velocity of the spray and urges it through the radiator core 12. The shroud 34 further controls the direction of air movement and the washing fluid mixture spray toward the radiator core 12.

Because the washing system is carried on the machine and easy to use, the frequency of washing is increased. This results in improved efficiency and operation of the machine 20 upon which it is installed.

Other aspects, objects and advantages of the present invention may be obtained from a further reading of the specification, the drawings and appended claims.

I claim:

1. A washing system for a mobile work machine having a frame, and an internal combustion engine mounted on said frame, comprising:

a sprayer having a manifold and a plurality of spaced apart nozzles connected to said manifold, said sprayer being connected to said frame and said nozzles being adapted to deliver a washing fluid mixture spray, said manifold having a circular configuration, said nozzles being disposed substantially equally spaced about the circular configured manifold, oriented to spray in substantially a common direction toward said radiator and in an overlapping spray pattern with an adjacent pair of spray nozzles;

a radiator having a cooling core and being connected to said frame, said radiator being connected to cool said engine, said radiator being positioned on the frame at a location to receive said spray of the washing fluid mixture;

a concentrate reservoir connected to the frame and being adapted to carry a concentrated cleaning fluid therein;

a source of pressurized water flow;

a mixing device being connected to the machine frame, the concentrate reservoir, and the manifold, said mixing device drawing concentrated cleaning fluid from said concentrate reservoir, combining a predetermined amount of concentrated cleaning fluid with water delivered from the source of pressurized water flow to the mixing device based on the rate of water flowing through the mixing device, and delivering the resulting washing fluid mixture to said manifold; and a fan connected to said frame and rotatable to urge the spray of washing fluid mixture through the radiator core.

2. A washing system, as set forth in claim 1, wherein said fan is disposed between the manifold and the radiator core.

3. A washing system, as set forth in claim 1, wherein the radiator core is located between the manifold and the fan.

4. A washing system, as set forth in claim 1, including, a coupling connected to the mixing device and being connectable to the source of pressurized water flow.

5. A washing system, as set forth in claim 4, wherein said source of pressurized water flow is remote from said mobile work machine and free from being mounted on the mobile machine.

6. A washing system, as set forth in claim 4, wherein said coupling is external from said mobile machine and externally accessible, said source of pressurized water flow being connectable to said externally accessible coupling.

7. A washing system, as set forth in claim 1, wherein said source of pressurized water flow is mounted on said mobile machine.

8. A washing system, as set forth in claim 7, wherein said source of pressurized water flow includes a water carrying reservoir and a pump connected to said water carrying reservoir and said mixing device.

9. A washing system, as set forth in claim 1, wherein said source of pressurized water flow includes a water carrying reservoir and a pump connected to said water carrying reservoir.

10. A washing system, as set forth in claim 1, wherein said mixing device includes;

a body having an inlet port, an outlet port, and a venturi passage having a throat portion disposed in the body;

a suction tube connected to open into the said throat portion and being disposed in the concentrate reservoir, said inlet port being connected to said source of pressurized water flow and said outlet port being connected to said manifold.

11. A washing system, as set forth in claim 10, including a vent pipe connected to and open to said concentrate reservoir, said vent pipe venting said concentrate reservoir to the atmosphere.

12. A washing system, as set forth in claim 11, including a concentrate fill tube connected to said concentrate reservoir, said concentrate fill tube having a filling end and said filling end being external relative to said mobile work machine.

* * * * *